United States Patent [19]

Seagel

[11] 4,001,853

[45] Jan. 4, 1977

[54] PHOTO DEVELOPMENT INSERT

[76] Inventor: William B. Seagel, 16123 Pioneer Blvd., No. 15, Norwalk, Calif. 90650

[22] Filed: Aug. 11, 1975

[21] Appl. No.: 601,014

[52] U.S. Cl. ..... 354/315; 40/158 B; 354/344; 354/347

[51] Int. Cl.[2] ..... G03D 17/00

[58] Field of Search ..... 354/315, 329, 340, 344, 354/347, 346; 40/124.4, 152.1, 158 R, 158 B

[56] References Cited

UNITED STATES PATENTS

| | | | |
|---|---|---|---|
| 2,813,471 | 11/1957 | Lobachewski | 354/344 |
| 3,054,341 | 9/1962 | Wolber | 354/344 |
| 3,292,520 | 12/1966 | Tucker | 354/344 |
| 3,741,099 | 6/1973 | Buckley | 354/344 |
| 3,831,301 | 8/1974 | Reynard | 40/158 B |

*Primary Examiner*—R. L. Moses

[57] ABSTRACT

A photographic developer insert adapted to accommodate from one to several prints or negatives of various sizes that are to be disposed in a photo-processing tank, the insert being formed from a single sheet of thin plastic material defining a jacket having parallel retaining lip edges and a centrally positioned dual-flanged partition, wherein the various sized prints or negatives are firmly held in place within the jacket, either from edge to edge or edge to the central partition, depending on the number and sizes of the prints or negatives.

3 Claims, 5 Drawing Figures

PHOTO DEVELOPMENT INSERT

BACKGROUND

1. Field of the Invention

This invention relates generally to photographic equipment used in the process of developing prints and negatives and, more particularly, to an insert jacket for retaining the prints and negatives in their proper relationship during the photographic process.

2. Description of the Prior Art

As is well known in the art of film processing, various types of equipment are presently in use. However, problems and difficulties are encountered in providing a simple, economic method and/or equipment that will enable the average photographer to process his own photographic work.

Generally, very elaborate darkroom areas are built, which include equipment to develope and enlarge, both negatives and prints of the known black and white variety, plus additional equipment to process color films.

As an example, a photographer is now required to have a separate developing tank for each particular process; that is, there must be a tank for color processing, one just for the use of printing paper, and still another for the negative development process.

Accordingly, the hobby of photography could be enlarged to encompass many who at the present time do not have the funds necessary to provide a fully-equipped dark room, note the time required to go through all the various step-by-step methods of developing film. Thus, millions of camera owners who have always wanted to develope and print their own pictures have not done so due to the present procedures which are not only too costly, but also too messy and too time-consuming as well.

The invention as will hereinafter be disclosed provides one element which is used in a new developing process that answers or eliminates the above-mentioned problems.

SUMMARY

This invention provides a device which aids in a new process for developing prints and negatives, whether black and white or color, the device being a photodeveloper insert forming a flexible jacket made of a chemical-resistant, tough plastic formed from a thin sheet of plastic material.

The jacket includes a pair of parallel leading edges formed with inturned lip members providing a retaining means for the various films and materials that are received therein.

Centrally disposed and integrally formed as part of the plastic sheet is a central partition having dual elongated flanges, which are also arranged in parallel relation to the lip members, thereby providing additional retaining means. That is, the insert jacket is so designed to hold one 8 ×10 inches, two 5 ×7 inches, four 4 ×5 inches or six 3 ½×5 inches photo prints; or, the combination of any of these can be arranged to be held and retained within the jacket retaining means.

The insert jacket has been designed to be used in a new photographic process, which will be described in a separate application, wherein a single tank is used along with the insert to develop black and white films and prints, as well as the color variety.

OBJECTS AND ADVANTAGES OF THE INVENTION

The present invention has for an important object a provision whereby films and prints of various sizes are retained in a selected arrangement within the insert jacket, wherein the insert and its contents can be easily disposed within any of the well known photodeveloping tanks.

It is another object of the invention to provide a photo-developing insert jacket that is capable of retaining both negative films or positive prints wihout contacting other films or prints.

It is a further object of the invention to provide a photo-developing insert jacket that is simply made from a single sheet of flexible plastic that is capable of withstanding the chemicals used in photo processing.

A still further object of the invention is to provide a device of this character that is simple and rugged in construction.

It is still another object of this invention to provide a device of this character having a relatively long working life.

It is a further object of the invention to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
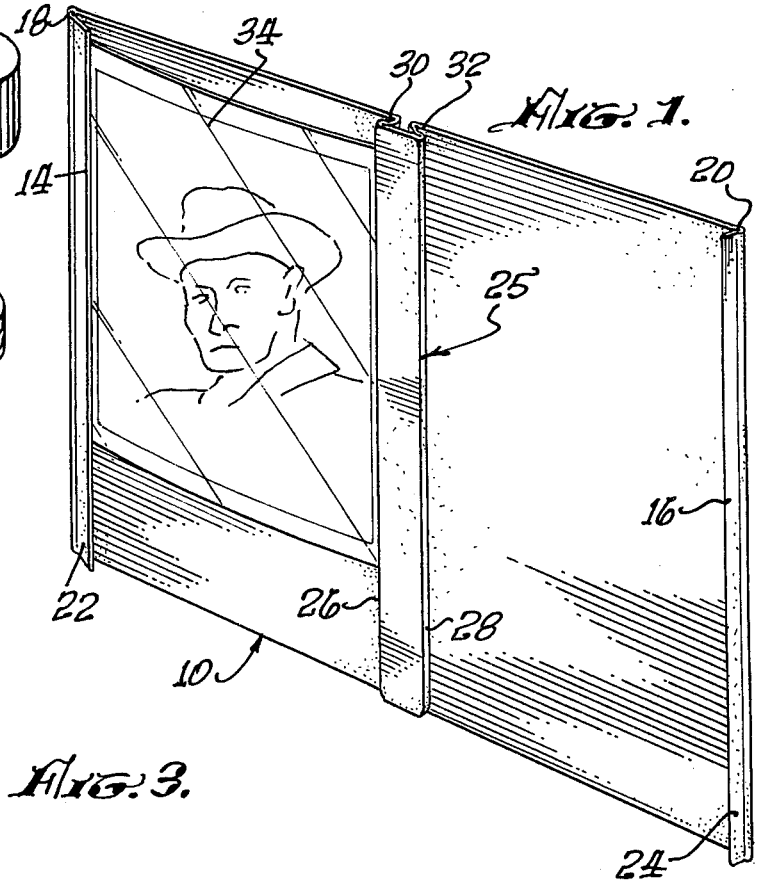
FIG. 1 is a perspective view of the present invention wherein a print is illustrated as being retained between one retaining edge and the central retaining partition.
Figure 2:
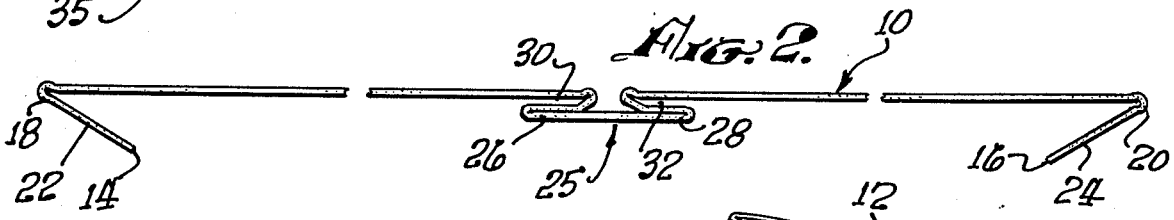
FIG. 2 is an enlarged top plan view thereof showing the insert jacket as being a single sheet of material.
Figure 5:
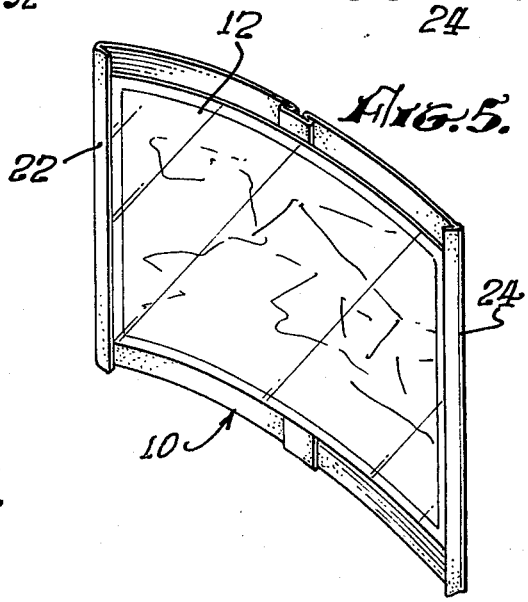
FIG. 5 is a perspective view of the present invention illustrating the mounting of a large photo print, whereby the print is held in position by the oppositely disposed, parallel lip members formed along the vertical edges thereof.

Referring more particularly to the drawings, there is shown in FIG. 1 a photographic developer insert, generally indicated at 10, having mounted therein a photo print 12. The insert 10 acts as a jacket and will be hereinafter referred to as the "insert jacket." Said insert jacket comprises a single sheet of plastic material of any well known type that is capable of withstanding various photo-processing chemicals. This sheet is easily formed by heat treating the areas that are required to be established thereon. As an example, each vertical free edge 14 and 16 is creased longitudinally along a parallel line 18 and 20 with respect to each respective free edge 14 and 16. Thus, by creasing along adjacent areas of the edges as seen in the drawings, there are readily formed inwardly extending lip members 22 and 24, respectively, the crease being formed by said heating treatment, which is well known in the art and therefore is not shown or described herein. Thus, the lips 22 and 24, along with corresponding creases, provide an outer edge retaining means wherein a film or print, such as 12, is readily received and held in place by the inherent flexibility of the heat-treated plastic sheet and the longitudinal folded lips 22 and 24. This is well illustrated in FIG. 5 wherein print 12 is shown positioned from one lip to the other.

Further, to accommodate smaller size films and prints, a central-retaining means is provided which is generally indicated at 25. Said central-retaining means comprises dual flanges 26 and 28 formed by an inward fold along the vertical, central portion of sheet 10. Each flange is doubled back on itself and heat treated, whereby a pair of oppositely disposed grooves 30 and 32 are formed. Thus, as seen in FIG. 1, a smaller print 34 is inserted between lip 22 of the leading edge 14 and groove 30 defined by flange 26.

Accordingly, it can be seen that various sized prints and films are capable of being retained in the insert jacket 10. As an example, the insert jacket will hold one 8 ×10 inches, two 5 ×7 inches, four 4 ×5 inches or six 3 ½×5 inches photo prints, or any combination that might be required.

Figure 3:
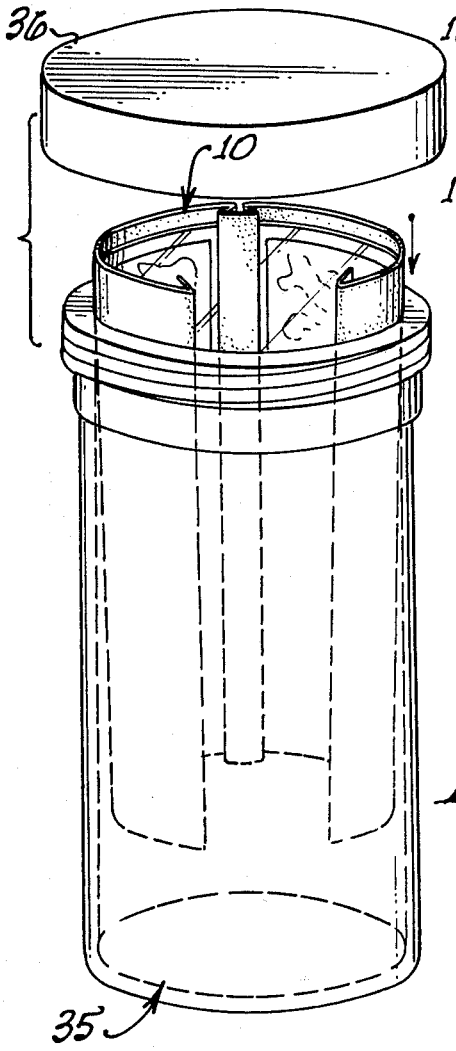
FIG. 3 is a perspective view of the insert jacket being received within a developing tank, wherein a pair of photos are mounted therein.
Figure 4:
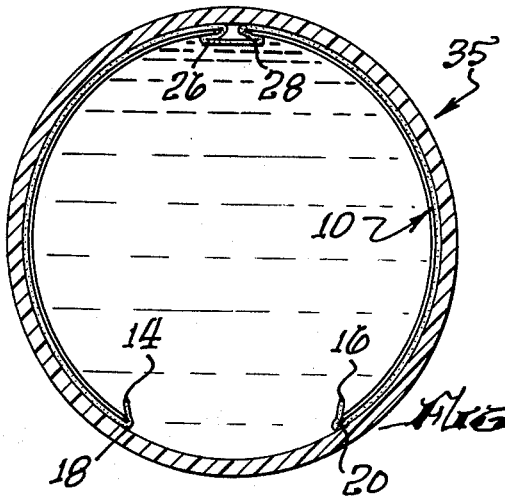
FIG. 4 is a horizontal, cross-sectional view of the tank and jacket disposed therein.

The flexibility of the sheet material is necessary in order to carry out the overall requirements of the device. That is, once the films or prints are positioned within the jacket 10, the jacket is rolled in the manner shown in FIG. 3, whereby the prints are facing inwardly towards each other and then inserted into a developing tank, as designated at 35, and also shown in FIG. 4. There are several developing tanks available in which the jacket can be readily received for processing the films or prints. As is well known, the tanks are adapted to hold the photo-processing chemicals along with the particular prints or films to be developed. A cap 36 is used to seal both within the tank 35. However, for each type of film or print — color as well as black and white — there must be provided a specially designed developing tank. With the above-disclosed jacket, any one of the known tanks can be used during any given developing process.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. A photographic developing insert jacket adapted to be inserted into a developing tank for processing photographic material comprising:

a relatively flexible, thin sheet of plastic material;

a pair of oppositely disposed leading edges formed as a first retaining means wherein prints or films are positioned therebetween;

wherein each of said first retaining means comprises a heat-treated crease line formed longitudinally adjacent to each of said leading edges, thereby forming a longitudinal lip member, said lip member being folded inwardly of said sheet, whereby said films or prints are inserted and retained therein; and a second retaining means centrally positioned between said first retaining means and arranged in parallel relation thereto.

2. A photographic developing insert jacket as recited in claim 1, wherein said second retaining means comprises dual flanges formed longitudinally in parallel relation to each leading edge lip member, said flanges being formed as an integral part of said sheet, wherein there is defined a groove to receive said films or prints inserted therein.

3. A photographic developing insert jacket as recited in claim 2, wherein said flanges are formed by a double fold of the sheet and heat treated into a fixed arrangement, whereby said grooves are permanently fixed therein.

* * * * *